US008066268B2

(12) United States Patent
Brauer

(10) Patent No.: US 8,066,268 B2
(45) Date of Patent: Nov. 29, 2011

(54) POWER TOOL DRIVER HOLDER

(76) Inventor: Charles E. Brauer, North Tonawanda, NY (US); Mary A. Brauer, legal representative, North Tonawanda, NY (US)

( * ) Notice: Subject to any disclaimer, the term of this patent is extended or adjusted under 35 U.S.C. 154(b) by 0 days.

(21) Appl. No.: 12/874,492

(22) Filed: Sep. 2, 2010

(65) Prior Publication Data

US 2011/0062296 A1 Mar. 17, 2011

Related U.S. Application Data

(60) Provisional application No. 61/243,234, filed on Sep. 17, 2009.

(51) Int. Cl.
*B25B 1/22* (2006.01)

(52) U.S. Cl. ..... 269/130; 269/6; 269/3

(58) Field of Classification Search ..... 269/130, 269/131, 6, 3; 206/350, 379, 362, 371, 372, 206/363

See application file for complete search history.

(56) References Cited

U.S. PATENT DOCUMENTS

| | | | | |
|---|---|---|---|---|
| 4,508,221 | A * | 4/1985 | Olson | 206/379 |
| 4,797,040 | A | 1/1989 | Hibbard | |
| 5,056,661 | A | 10/1991 | Balzano | |
| 5,188,242 | A * | 2/1993 | Smith | 211/69 |
| 5,810,525 | A | 9/1998 | Ector, Sr. | |
| 5,842,584 | A * | 12/1998 | Baird | 211/69.1 |
| 6,098,558 | A * | 8/2000 | Baird | 112/475.08 |
| 6,729,480 | B1 * | 5/2004 | Blake | 211/70.6 |
| 6,910,578 | B2 | 6/2005 | Stern | |
| 7,314,142 | B2 * | 1/2008 | Lyman, Jr. | 211/69.5 |

* cited by examiner

*Primary Examiner* — Lee D Wilson

(74) *Attorney, Agent, or Firm* — James Ray & Associates, LLC

(57) ABSTRACT

The present invention can be used to hold one's screw driving bits directly on the tool so a specific bit can easily be found and employed as needed. Each holder may be produced from a heavy duty plastic or rubber. There may be approximately 8-10 openings for assorted bits, which allow 16-20 different bits to be inserted. The bits may stick out the top and bottom of the holder so a user may see exactly what type each is.

9 Claims, 5 Drawing Sheets

POWER TOOL DRIVER HOLDER

CROSS-REFERENCE TO RELATED APPLICATIONS

This application is related to and claims priority from provisional patent application 61/243,234 filed Sep. 17, 2009 and is herein incorporated by reference.

FIELD OF THE INVENTION

This invention generally pertains to power tools and accessories for such. More specifically, the present invention relates to a power tool driver and extension holder.

BACKGROUND OF THE INVENTION

The invention is particularly applicable to electric power tools and accessories and will be described with particular reference thereto. However, it will be appreciated by those skilled in the art that the invention has broader applications and may also be adapted for use in other applications.

When utilizing an electric drill, one may easily reach for an undesired screw driving bit when not closely looking. This may cause the individual to stop what they are doing to retrieve the correct bit. This can be time consuming and aggravating especially if one must descend a ladder to obtain the needed bit. Keeping multiple bits in one's pocket may also create problems. Bits may easily fall from the pocket and become lost or a user may still have to take time to look through each bit for a specific one.

SUMMARY OF THE INVENTION

The present invention offers consumers a simple way to affix an assortment of screw driving bits directly to the tool for use. This unique product can assist users in having a variety of screw driving bits readily available so projects can be completed in a timely manner. This innovative item is ideal for use by professionals that utilize drills as well as do-it-yourselfers looking for a way to keep various screw driving bits close by so they can quickly and effectively be obtained when needed. An optional extender may also be beneficial to use when one may desire to keep a larger assortment of bits close by.

The present invention can be used to hold one's screw driving bits directly on the tool so a specific bit can easily be found and employed as needed. Each holder may be produced from a heavy duty plastic or rubber. There may be approximately 8-10 openings for assorted bits, which allow 16-20 different bits to be inserted. The bits may stick out the top and bottom of the holder so a user may see exactly what type each is. A first design may feature hook and loop fastening straps that allow the unit to be secured around the front and back barrel of a drill. A second design may include the product being attached to the drill with an epoxy. A third design may have the bit holder built directly into the drill. The unit may measure approximately ¾" high, 4" long and ½" wide. The exact dimensions, materials used for construction and method of operation of the present invention may vary depending on application.

OBJECTS OF THE INVENTION

It is, therefore, one of the primary objects of the present invention to provide a drill bit holder that overcomes the disadvantages of the prior art.

Another object of the present invention is to provide a drill bit holder that can be secured to a wide variety of power tools.

In one embodiment the invention is a driver holder comprising: a generally rectangular block, a plurality of apertures, a fastening means, wherein said plurality of apertures begin at a first end of said generally rectangular block through to a second end of said generally rectangular block. In another embodiment said fastening means comprises hook and loop fasteners. In still another embodiment said fastening means comprises an adhesive. In yet still another embodiment said fastening means comprises an epoxy. In yet another embodiment said fastening means comprises at least two elongated members comprising hook and loop fasteners. In but still another embodiment said plurality of apertures are capable of holding two drivers per aperture. In another embodiment the invention further comprises at least two substantially C-shaped members capable of holding a driver extension.

In one embodiment the invention is a driver holder comprising: a generally rectangular block, a plurality of apertures, a fastening means, at least two substantially C-shaped members capable of holding a driver extension, wherein said plurality of apertures begin at a first end of said generally rectangular block through to a second end of said generally rectangular block. In another embodiment said fastening means comprises an epoxy. In yet another embodiment said fastening means comprises at least two elongated members comprising hook and loop fasteners. In still another embodiment said fastening means comprises a housing for at least partly covering a power tool.

It is to be understood that both the foregoing general description and the following detailed description are merely exemplary of the invention, and are intended to provide an overview or framework for understanding the nature and character of the invention as it is claimed. The accompanying drawings are included to provide a further understanding of the invention, and are incorporated in and constitute a part of this specification. The drawings illustrate various embodiments of the invention; and together with the description serve to explain the principles and operation of the invention.

Figure 1:
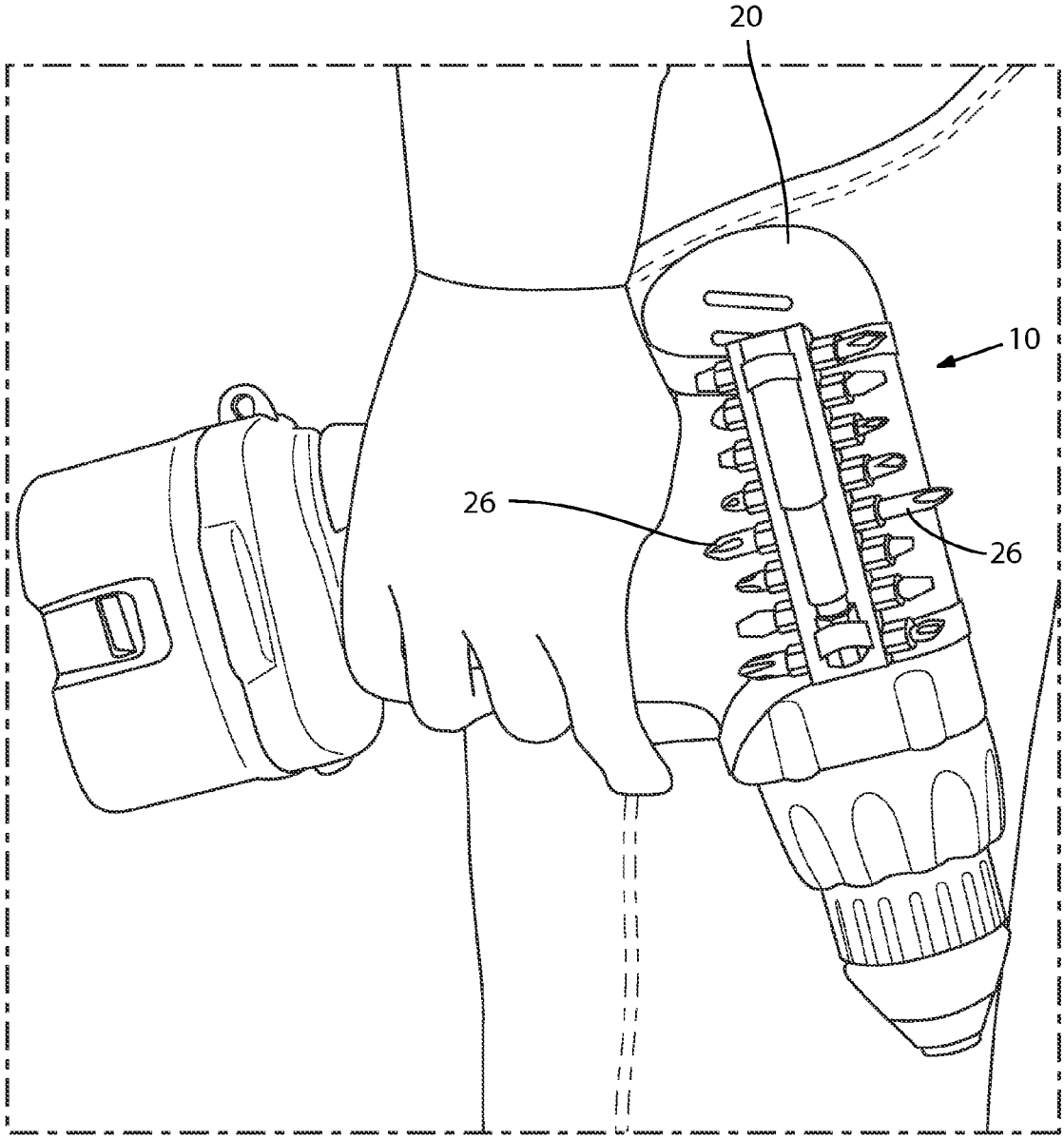
FIG. 1 is a general perspective view of a preferred embodiment of the invention secured to a cordless power drill.

BRIEF DESCRIPTION OF A PRESENTLY PREFERRED AND VARIOUS ALTERNATIVE EMBODIMENTS OF THE INVENTION

Prior to proceeding to the more detailed description of the present invention it should be noted that, for the sake of clarity and understanding, identical components which have identical functions have been identified with identical reference numerals throughout the several views illustrated in the drawing figures.

Figure 2:
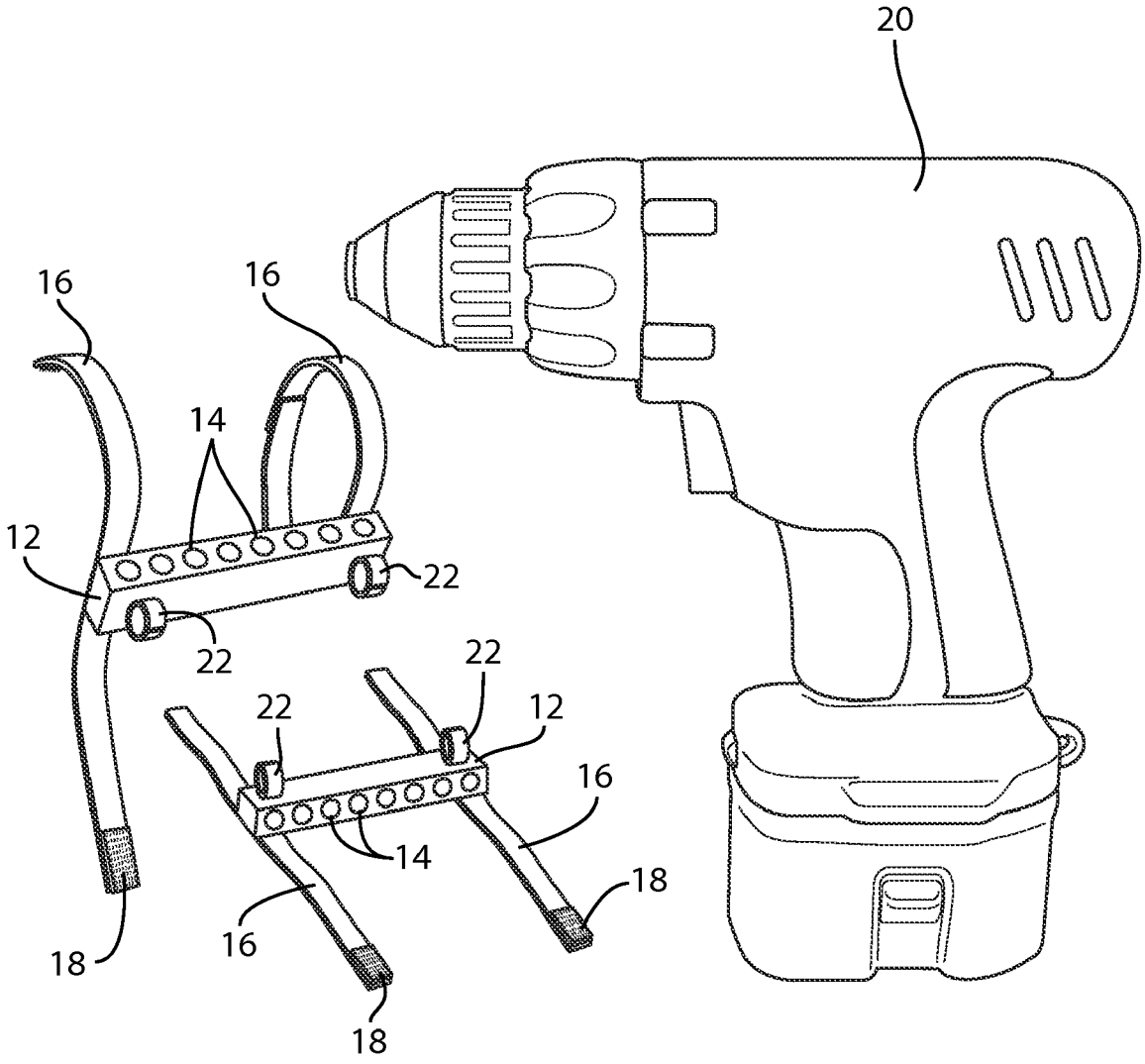
FIG. 2 shows two general perspective views of a preferred embodiment of the invention with a cordless power drill.
Figure 3:
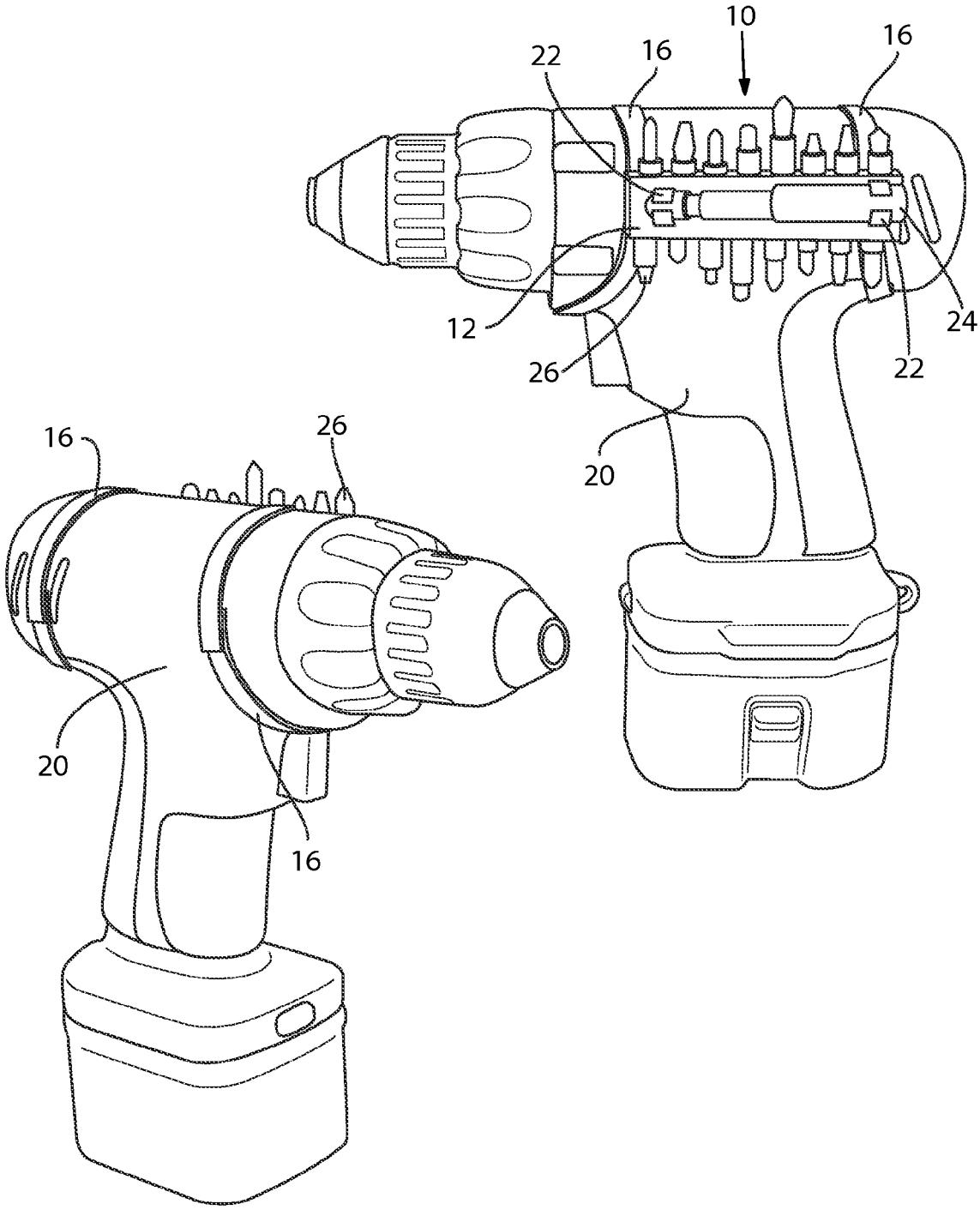
FIG. 3 shows two general perspective views of a preferred embodiment of the invention secured to a cordless power drill.

Reference is now made to FIGS. 1-5, more particularly, to FIGS. 1-3 which shows a first preferred embodiment of the present invention 10. The first preferred embodiment comprises a substantially rectangular block 12 with apertures 14, for holding drivers 26, that pass through said substantially rectangular block 12. Straps 16 with hook and loops fasteners 18 are attached to said rectangular block 12. Straps 16 with hook and loops fasteners 18 are used to secure the present invention 10 to a cordless power drill 20. Attached to the exterior of substantially rectangular block 12 may be substantially C-shaped members 22 for holding a drive extension 24.

Figure 4:
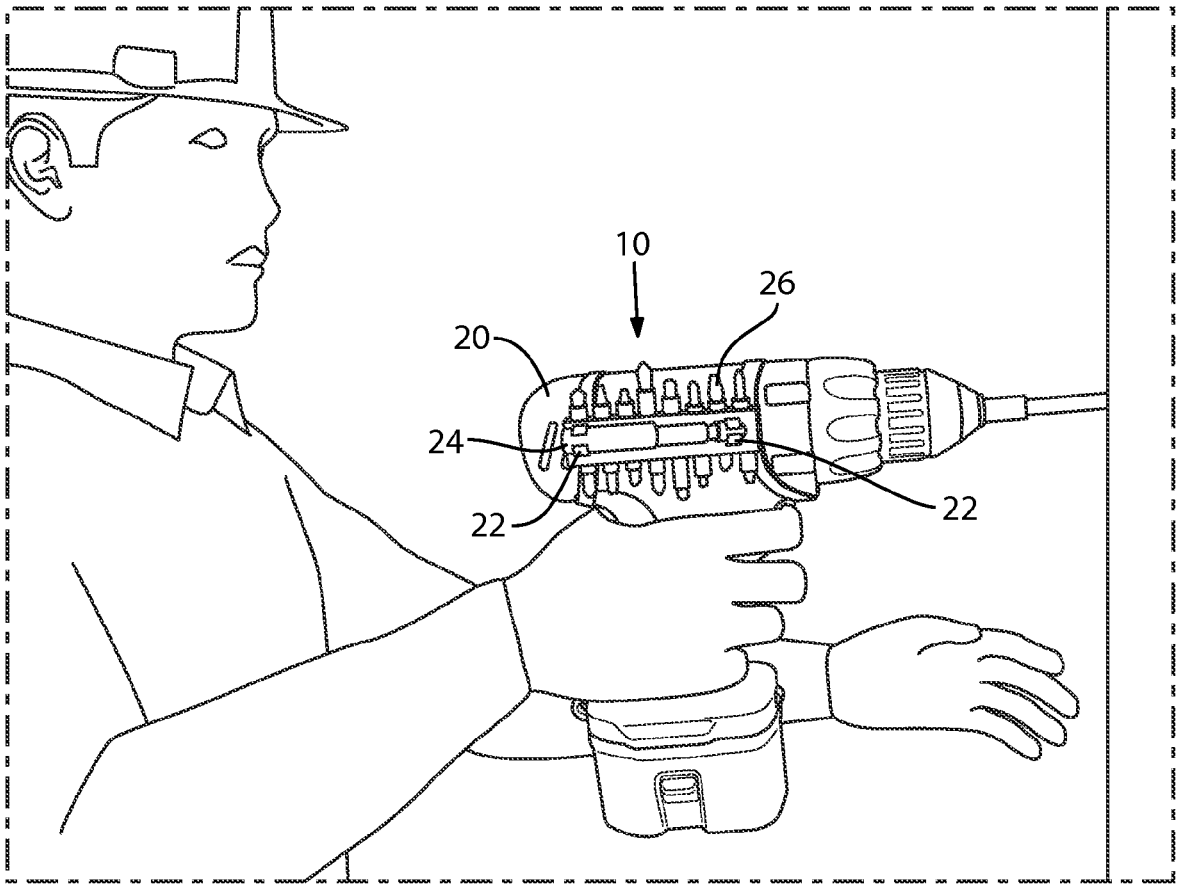
FIG. 4 is a general perspective view of a preferred embodiment of the invention secured to a cordless power drill.

Reference is now made to FIG. 4, which shows a second preferred embodiment of the present invention 10. In this embodiment substantially rectangular block 12 with apertures 14 is secured to a cordless power drill 20 by means of an epoxy. The epoxy could be applied upon manufacture or as an aftermarket modification to the cordless power drill 20.

Figure 5:
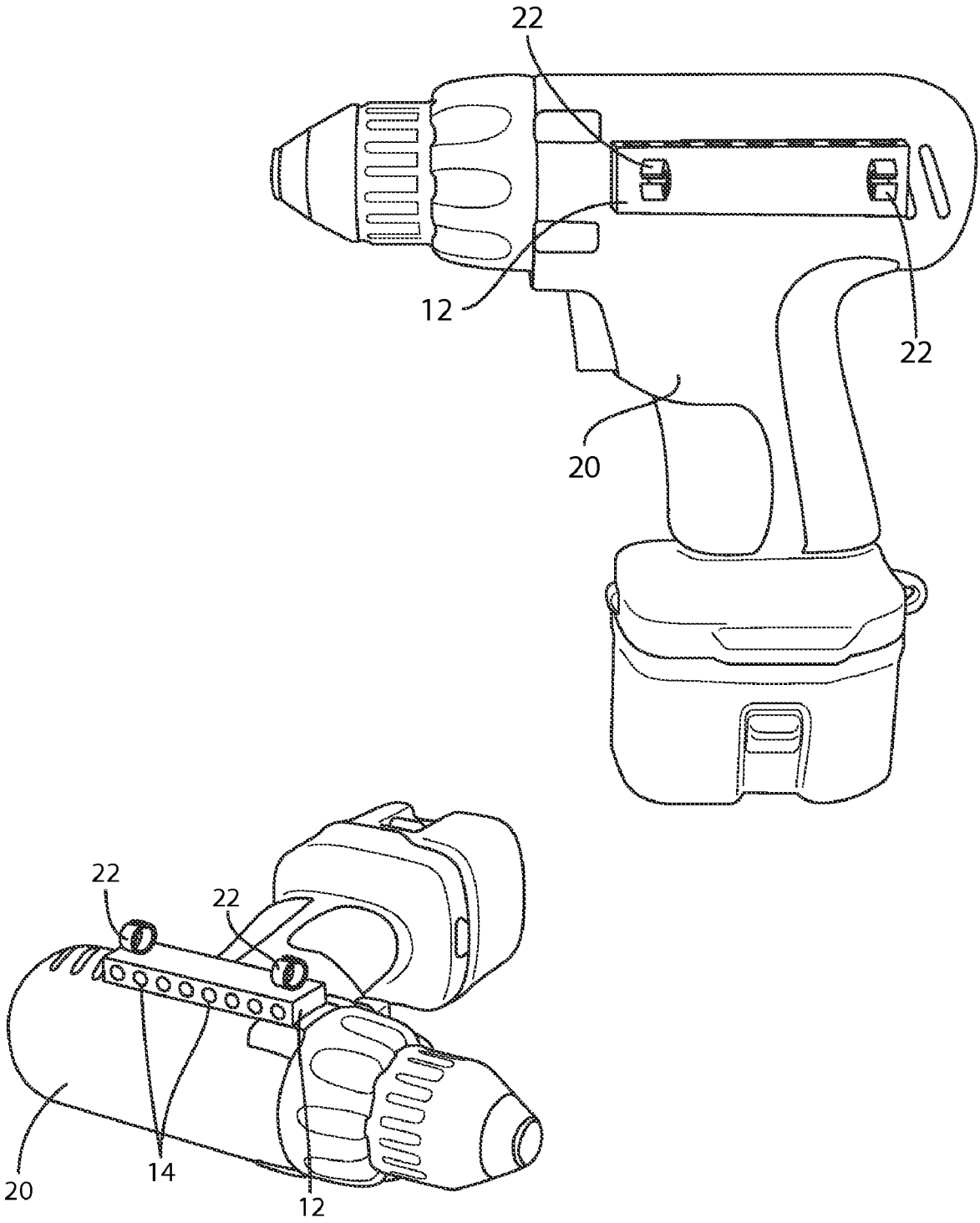
FIG. 5 shows two general perspective views of a preferred embodiment of the invention integrated into the housing of cordless power drill.

Reference is now made to FIG. 5, which shows a third preferred embodiment of the present invention 10. In this embodiment substantially rectangular block 12 with apertures 14 is integrated into the housing of the cordless power drill 20.

While a presently preferred and various alternative embodiments of the present invention have been described in sufficient detail above to enable a person skilled in the relevant art to make and use the same, it should be obvious that various other adaptations and modifications can be envisioned by those persons skilled in such art without departing from either the spirit of the invention or the scope of the appended claims.

What is claimed:

1. A driver holder comprising:

a generally rectangular block, a plurality of apertures, a fastening means, wherein said plurality of apertures begin at a first end of said generally rectangular block through to a second end of said generally rectangular block, and wherein said plurality of apertures are capable of holding two drivers per aperture and said generally rectangular block having at least two substantially C-shaped members configured to hold an extension driver with said substantially C-shaped members being on a side of said generally rectangular block with said side being perpendicular to said plurality of aperture.

2. The driver holder of claim 1, wherein said fastening means comprises hook and loop fasteners.

3. The driver holder of claim 1, wherein said fastening means comprises an adhesive.

4. The driver holder of claim 1, wherein said fastening means comprises an epoxy.

5. The driver holder of claim 1, wherein said fastening means comprises at least two elongated members comprising hook and loop fasteners.

6. The driver holder of claim 1, further comprising said at least two substantially C-shaped members including a slot capable of removeably holding a driver extension.

7. A driver holder comprising:

a generally rectangular block, a plurality of apertures, a fastening means, at least two substantially C-shaped members capable of holding a driver extension, wherein said plurality of apertures begin at a first end of said generally rectangular block through to a second end of said generally rectangular block and said generally rectangular block having said at least two substantially C-shaped members configured to hold an extension driver with said substantially C-shaped members being on a side of said generally rectangular block with said side being perpendicular to said plurality of aperture.

8. The driver holder of claim 7, wherein said fastening means comprises an epoxy.

9. The driver holder of claim 7, wherein said fastening means comprises at least two elongated members comprising hook and loop fasteners.

* * * * *